US010151116B2

(12) United States Patent
Thompson et al.

(10) Patent No.: US 10,151,116 B2
(45) Date of Patent: Dec. 11, 2018

(54) AWNING CANOPY ASSEMBLY

(71) Applicant: CAREFREE/SCOTT FETZER COMPANY, Harrison, OH (US)

(72) Inventors: Scott Patrick Thompson, Aspen, CO (US); Vincent Frerich, Arvada, CO (US)

(73) Assignee: Carefree/Scott Fetzer Company, Broomfield, CO (US)

( * ) Notice: Subject to any disclaimer, the term of this patent is extended or adjusted under 35 U.S.C. 154(b) by 0 days.

(21) Appl. No.: 15/469,090

(22) Filed: Mar. 24, 2017

(65) Prior Publication Data

US 2017/0275885 A1 Sep. 28, 2017

Related U.S. Application Data

(60) Provisional application No. 62/312,575, filed on Mar. 24, 2016.

(51) Int. Cl.
*E04F 10/06* (2006.01)

(52) U.S. Cl.
CPC ..... *E04F 10/0629* (2013.01); *E04F 10/0614* (2013.01); *E04F 10/0625* (2013.01); *E04F 10/0648* (2013.01); *E04F 10/0651* (2013.01); *E04F 10/0655* (2013.01); *E04F 10/0662* (2013.01)

(58) Field of Classification Search
CPC ..... E04F 10/0629; E04F 10/0625; E04F 10/0633; E04F 10/0648; E04F 10/0655; E04F 10/0659; E04F 10/0662; E04F 10/0685; E04F 10/0696; E04F 10/0614; E04F 10/0651
USPC ..... 160/65–67, 69, 10, 78, 79
See application file for complete search history.

(56) References Cited

U.S. PATENT DOCUMENTS

| | | | | |
|---|---|---|---|---|
| 789,639 | A | 5/1905 | Thoms | |
| 934,605 | A | 9/1909 | Goudie | |
| 1,021,330 | A | 3/1912 | Price | |
| 1,050,341 | A * | 1/1913 | Christian | E04F 10/0614 160/65 |
| 1,076,310 | A | 10/1913 | Pennington | |
| 1,620,958 | A | 3/1927 | Girton et al. | |
| 1,742,437 | A | 1/1930 | Davenport | |
| 1,959,700 | A | 5/1934 | Anton et al. | |
| 2,321,801 | A | 6/1943 | Dazzo | |

(Continued)

*Primary Examiner* — Brian D Mattei
(74) *Attorney, Agent, or Firm* — John A. Yirga, Esq.; Tarolli, Sundheim, Covell & Tummino LLP

(57) ABSTRACT

An awning assembly and method of construction that includes a first main member rotatably coupled to a vertical track at a first end of the first main member; a second main member pivotally coupled to and at a second end of the first main member; a first supplemental member rotatably and slidably connected to the vertical track at a first end of the first supplemental member; a second supplemental member having a first end pivotally coupled to and at a second end of the first supplemental member. The second supplemental member has a second end pivotally coupled to the second main member. The first main member includes first, second, and third cross-sections spaced the second cross-section comprising slot that allows for the passage of the first supplemental member through the first main member, wherein the first cross-section differs from the second cross-section.

17 Claims, 8 Drawing Sheets

(56) References Cited

U.S. PATENT DOCUMENTS

| | | | | |
|---|---|---|---|---|
| 2,567,424 | A | 9/1951 | D'Azzo | |
| 3,779,302 | A | 12/1973 | Akers et al. | |
| 3,847,171 | A | 11/1974 | Akers et al. | |
| 6,095,221 | A | 8/2000 | Frey, Jr. | |
| 6,273,172 | B1 | 8/2001 | Frey | |
| 6,341,638 | B1 | 1/2002 | Thompson et al. | |
| 6,971,433 | B2 | 12/2005 | Wagner et al. | |
| 9,850,663 | B1 * | 12/2017 | Thompson | E04F 10/04 |
| 2004/0221965 | A1 * | 11/2004 | Wagner | E04F 10/0614 160/67 |
| 2007/0113988 | A1 * | 5/2007 | Thompson | E04F 10/0625 160/70 |
| 2011/0048651 | A1 * | 3/2011 | Goth | E04F 10/0614 160/22 |
| 2013/0333846 | A1 * | 12/2013 | Albrecht | E04F 10/0614 160/66 |
| 2014/0262070 | A1 * | 9/2014 | Greer | E04F 10/0666 160/127 |
| 2015/0122081 | A1 * | 5/2015 | Martyn | F16H 21/04 74/99 R |
| 2015/0176285 | A1 * | 6/2015 | Albrecht | E04F 10/0614 160/59 |
| 2016/0186842 | A1 * | 6/2016 | Martyn | F16H 21/04 74/99 R |
| 2017/0088068 | A1 * | 3/2017 | Taylor | B60R 16/027 |
| 2017/0138056 | A1 * | 5/2017 | Albertson | E04F 10/0696 |

* cited by examiner

AWNING CANOPY ASSEMBLY

CROSS-REFERENCE TO RELATED APPLICATIONS

The present application claims priority under 35 U.S.C. § 119(c) to U.S. Provisional Patent Application Ser. No. 62/312,575 filed Mar. 24, 2016 entitled AWNING CANOPY ASSEMBLY. The above-identified application is incorporated herein by reference in its entirety for all purposes.

FIELD OF THIS DISCLOSURE

The present disclosure relates to an awning canopy assembly, and more particular, an awning assembly that is more compact in size than awnings having a similar strength when in an extended position.

BACKGROUND

An awning is a welcome addition to a house, recreational vehicle, or other dwelling. The awning typically provides increased enjoyment of an outdoor area surrounding the dwelling. The awning can cast a shaded area that creates an escape from direct sunlight, thereby providing a space in which an occupant of the dwelling may relax. The shaded area created by the awning contributes to the relaxation of the occupant in that there is a perceived decrease in temperature and, thus, generally becomes more comfortable. The awning as well advantageously protects occupants underneath from precipitation.

Known awning structures generally consist of a base that is permanently affixed to the dwelling, and a canopy that is removably attached to the base. Conventional awning structures are discussed in detail further in U.S. Pat. No. 6,971,433 assigned to Carefree/Scott Fetzer Company. U.S. Pat. No. 6,971,433 is incorporated herein by reference in its entirety for all purposes.

SUMMARY

One aspect of the present disclosure comprises an awning assembly that includes a vertical track at a first end of the first main member; a second main member pivotally coupled to and at a second end of the first main member; a first supplemental member rotatably and slidably connected to the vertical track at a first end of the first supplemental member; a second supplemental member having a first end pivotally coupled to and at a second end of the first supplemental member. The second supplemental member has a second end pivotally coupled to the second main member. The first main member includes first and second cross-sections spaced by a slot that allows for the passage of the first supplemental member through the first main member, wherein the first cross-section differs from the second cross-section. The first main member comprising first, second, and third cross-sections, the second cross-section comprising a slot that spaces the first and third cross-sections, the slot allowing for the passage of said first supplemental member through said first main member, wherein said first cross-section differs from said second cross-section.

Another aspect of the present disclosure comprises a method of constructing an awning assembly, the method comprising rotatably coupling a first main member to a vertical track at a first end of said first main member, pivotally coupling a second main member to and at a second end of the first main member, rotatably and slidably connecting a first supplemental member to said vertical track at a first end of said first supplemental member, said first supplemental member is pivotally connected to said first main member by a hinge pin, and pivotally coupling a first end of a second supplemental member having to and at a second end of the first supplemental member, the second supplemental member having a second end pivotally coupled to said second main member. The method further comprising providing said first main member with a first cross-section comprising a C-shaped channel, a second cross-section comprising a slot, and a third-cross-section comprising a second C-shaped channel, the slot spacing the first cross-section and third cross-section and allowing for the passage of said first supplemental member through said first main member.

Yet another aspect of the present disclosure comprises an awning assembly comprising at least one support structure coupled to a canopy. The at least one support structure having a first main member rotatably coupled to a vertical track at a first end of said first main member, wherein the vertical track is couplable to a support surface. The at least one support structure further having a second main member pivotally coupled to a second end of the first main member at a first end of the second main member, and coupled to the canopy at a second end of the second main member. The at least one support structure additionally having a first supplemental member comprising a first end rotatably and slidably connected to said vertical track, and a second supplemental member having a first end pivotally coupled to a second end of the first supplemental member, the second supplemental member having a second end pivotally coupled to said second main member. The first main member comprising a first cross-section, comprising a first C-shaped channel, and a second cross-section, comprising a slot formed through a C-shaped channel, and a third cross-section comprising a second C-shaped channel, the slot allowing for the passage of said first supplemental member through said first main member, wherein said first supplemental member is pivotally connected to said first main member by a hinge pin. The at least one support structure also having a gas spring, wherein said gas spring includes a first end and a second end, the first end being pivotally connected to said vertical track and said second end being connected to said hinge pin.

BRIEF DESCRIPTION OF THE SEVERAL VIEWS OF THE DRAWINGS

The foregoing and other features and advantages of the present disclosure will become apparent to one skilled in the art to which the present disclosure relates upon consideration of the following description of the disclosure with reference to the accompanying drawings, wherein like reference numerals, unless otherwise described refer to like parts throughout the drawings and in which.

Figure 1:
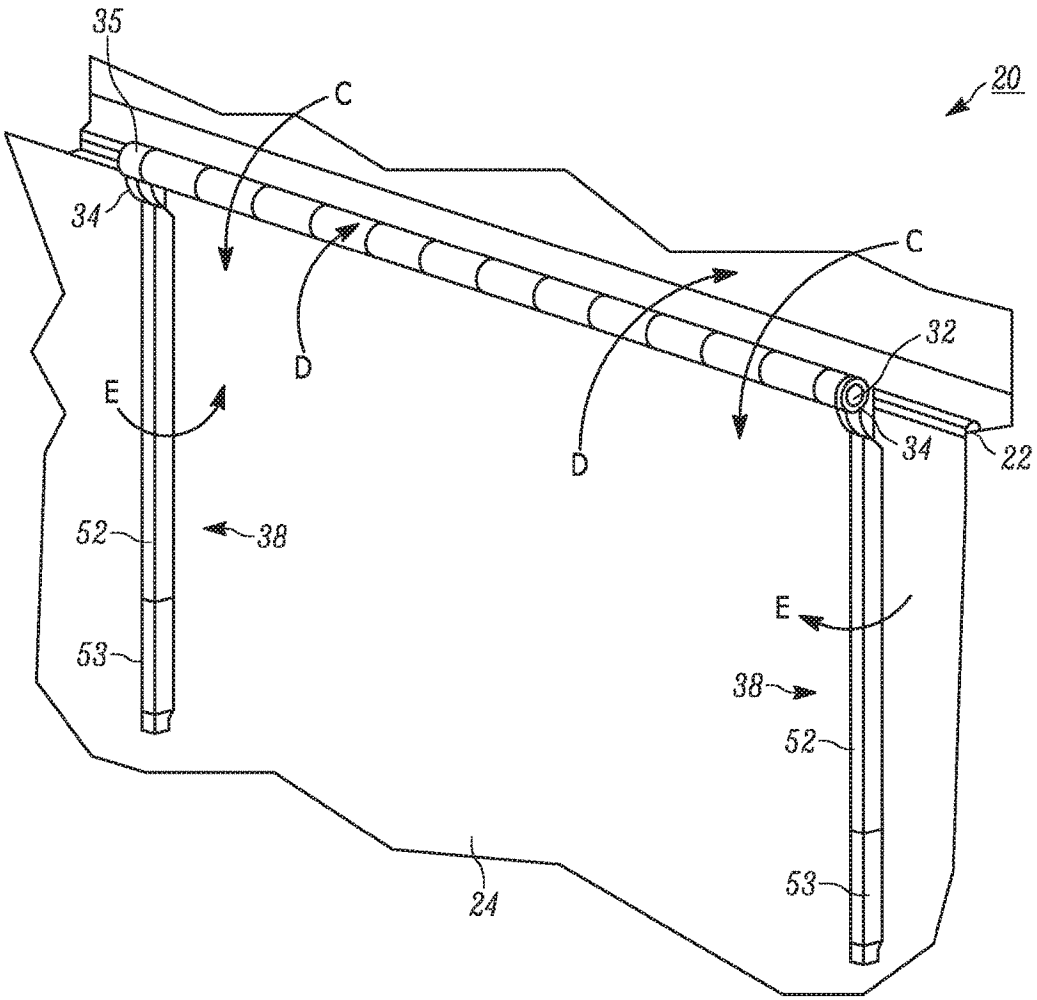
FIG. 1 is a side elevation view of an awning canopy assembly in a retracted position in accordance with one example embodiment of the present disclosure.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

The apparatus and method components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

DETAILED DESCRIPTION

Referring now to the figures generally wherein like numbered features shown therein refer to like elements having similar characteristics and operational properties throughout unless otherwise noted. The present disclosure relates to an awning canopy apparatus, and more particularly, an awning assembly that is more compact in size yet provides sufficient strength to the overall system when in an extended position over conventional awning structures.

Now referring to FIGS. 1-5, an awning assembly 20 is illustrated. The awning assembly 20 includes a flexible awning canopy 26 that is mounted to a vertical support surface 24, which might be for example, the side wall of a recreational vehicle, mobile home, a recreational vehicle slide-out, or more permanent building structure. The flexible awning canopy 26 includes an inner or proximal edge 28 secured to a support rail 22 and an outer edge 30 secured to a roll bar 32, which can be motor, manual, or spring driven by one or more motors 34, gears, or springs that are operatively connected to, and maintained by, a support system 36 in the form of a pair of scissor-type arms 38.

In the illustrated example embodiment of FIG. 1, the motors 34 are hidden or enclosed to be protected from the elements in respective housings or covers 35. The covers 35 are typically made from plastic or metal. In the illustrated example embodiment, the scissor-type arms 38 are constructed of metal, such as aluminum, but could be made of other materials of similar weight and strength.

The support system 36 shown in further detail in FIGS. 4-8 includes one of two scissors-type arms 38 (that support the awning assembly 20 only one of the two arms being shown in FIGS. 4-8) mounted on a vertical track 40 that during use would attach to the support surface 24. In the illustrated example embodiment, the vertical track 40 is coupled to a base portion 53. The support system 36 is shown extended in FIGS. 3 and 5 with the awning assembly 20 in the extended position. While the assembly 20 is fully retracted, as illustrated in FIG. 1, it will be appreciated that the support system 36 is vertically disposed and in close adjacent relationship with the track 40 during use. In the illustrated example embodiment of FIG. 1, a second main member 52 and the base portion 53 are aligned to form a substantially uniform appearance of the arms 38 when the support system is in a first closed position.

As will be appreciated, and as shown in the illustrated example embodiment of FIG. 1, as the motors 34 are driven in a first or second direction, represented by arrows C and D, respectively, the awning canopy 26 is rolled onto or unrolled from the roll bar 32 causing the awning 20 to retract or extend, respectively. The awning 20 retracts or extends in cooperation with gas springs 42 associated with the respective support arms 38. Responsive to the roll bar 32 being rotated in the first direction C to retract the awning assembly 20 by wrapping the awning canopy 26 about the roll bar, the support arms 38 are forced to retract in direction A against the bias of the gas springs 42 until the awning is in the fully retracted first position illustrated in FIG. 1.

Figure 2:
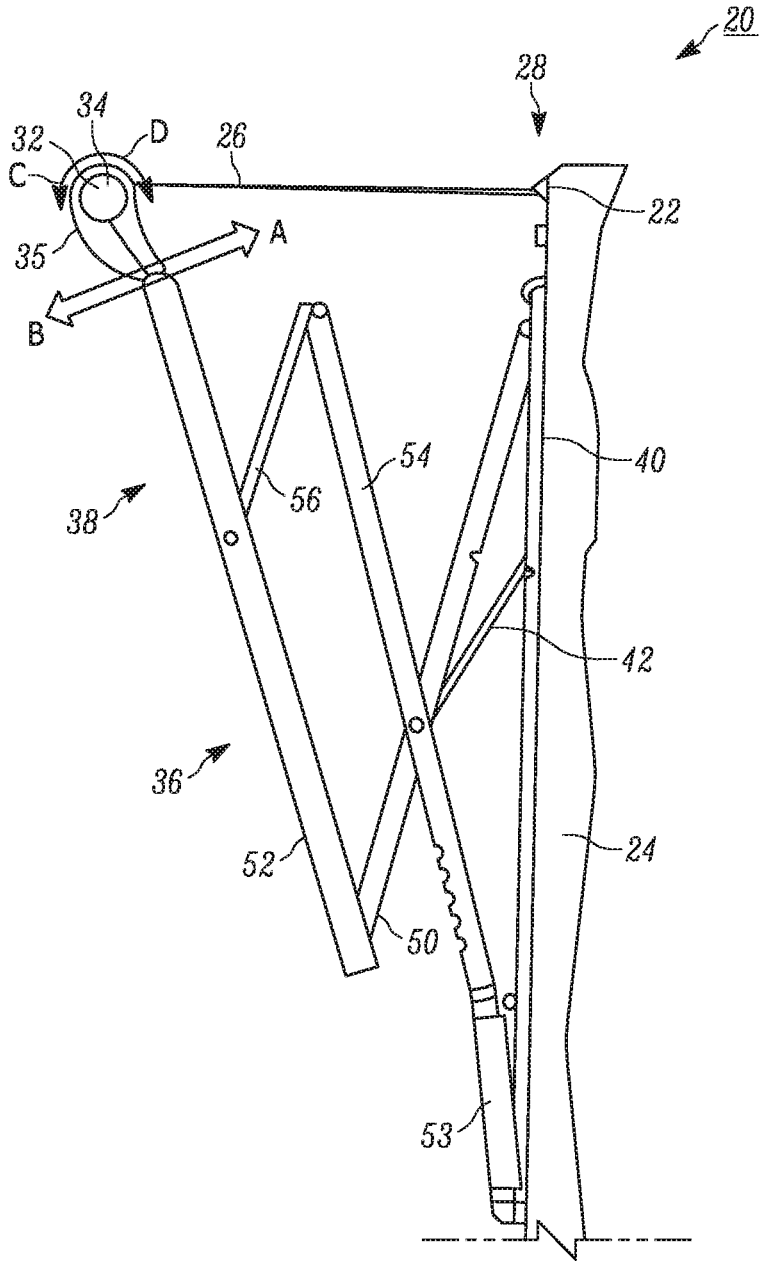
FIG. 2 is a left side elevation view of an awning canopy assembly in a partially expanded or partially open position in accordance with one example embodiment of the present disclosure.
Figure 3:
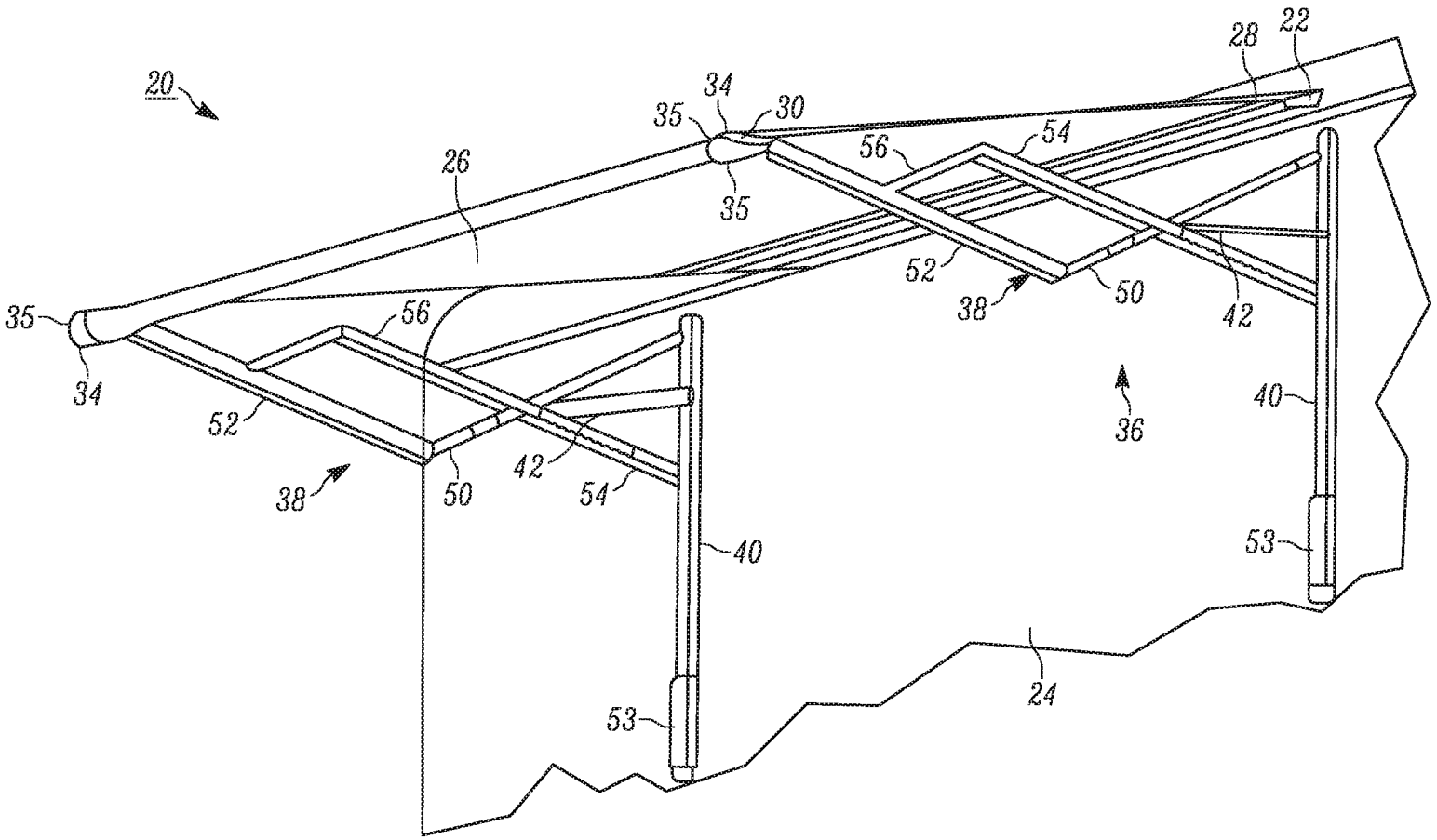
FIG. 3 is a perspective view of an awning canopy assembly in an open or expanded position in accordance with one example embodiment of the present disclosure.

To open the awning assembly 20, the roll bar 32 is rotated as shown in FIG. 2 in the second direction D to extend the awning in direction B by unwrapping the awning canopy 26 from the roll bar. The support arms 38 are assisted in extending by the bias of the gas springs 42 until fully extended to the second position illustrated in FIGS. 3 and 5.

It would be appreciated by one having ordinary skill in the art that additional example embodiments of the awning assembly 20 are contemplated. In one such example embodiment, the awning assembly 20 has support arms 38 that retract up and/or rotate inwards such as towards the roll bar 32 indicated by arrows E in FIG. 1 by a fixture assembly (not shown). Stated another way, the support system 36 when in the contracted position (see FIG. 1) can rotate such that the support system 36 that includes the vertical tracks 40 are parallel with the roll bar 32.

As shown in the example embodiments of FIGS. 4-8, the support system 36 of the awning canopy assembly 20 is illustrated. In one example embodiment, the support system 36 comprises a first support of a first side of the awning 20, wherein a mirror image of the support system 36 comprises a second support of a second side of the awning. The support system 36 comprises first and second main members 50, 52 and first and second supplemental members 54, 56, respectively. Each of the members 50-56 in the illustrated example embodiment are formed from metal, plastic, or the like. In one example embodiment, the members 50-56 are formed from extruded aluminum channeling.

The first member 50 is rotatably attached to the vertical track 40 by fixed pin 58 that passes through both the first member and track at a first end 72 of the first member. At a second end 74 of the first main member 50, a rotating pin 60 couples the first main member to the second main member 52, such that the two main members have relative rotation about the pin 60 as the awning assembly 20 moves between the fully retracted first position illustrated in FIG. 1 to the fully extended the second position illustrated in FIGS. 3 and 5. A slideable pin 62 allows for translation of the first supplemental member 54 about and within the vertical track 40 in the directions of arrows F in FIG. 4. The slideable pin 62 further allows for rotational pivoting of the first supplemental member 54 at a first end 76. At a second end 78 of the first supplemental member 54 a rotating pin 64 couples the first supplemental member to the second supplemental member 56, such that the two supplemental members have relative rotation about the pin 64 as the awning assembly 20 moves between the first and second positions. The opposite end of the second supplemental member 56 is rotatably coupled to a rotatable pin 70 that is fixedly attached to the second main member 52.

Figure 5:
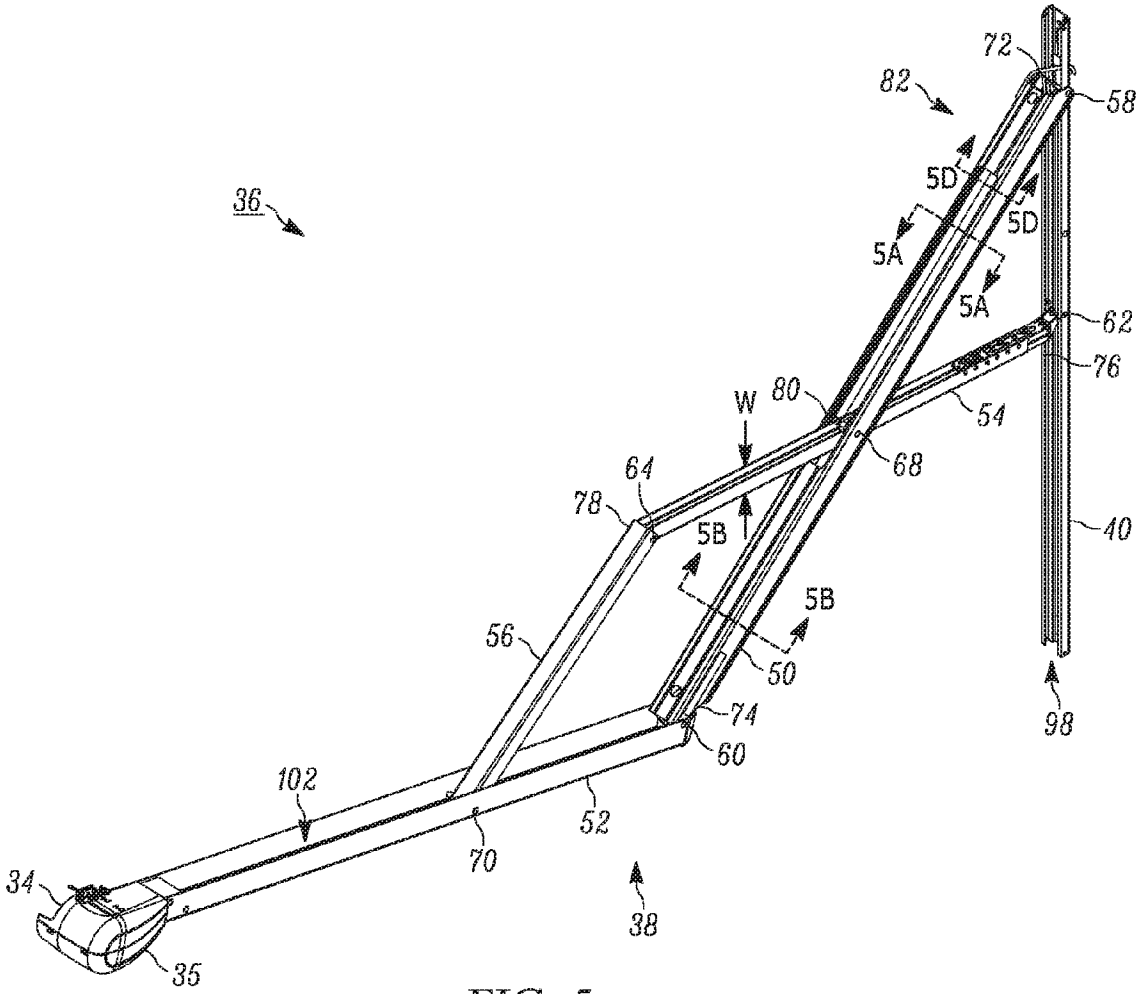
FIG. 5 is a second perspective view of an awning canopy assembly support system in accordance with another example embodiment of the present disclosure.
Figure 5A:
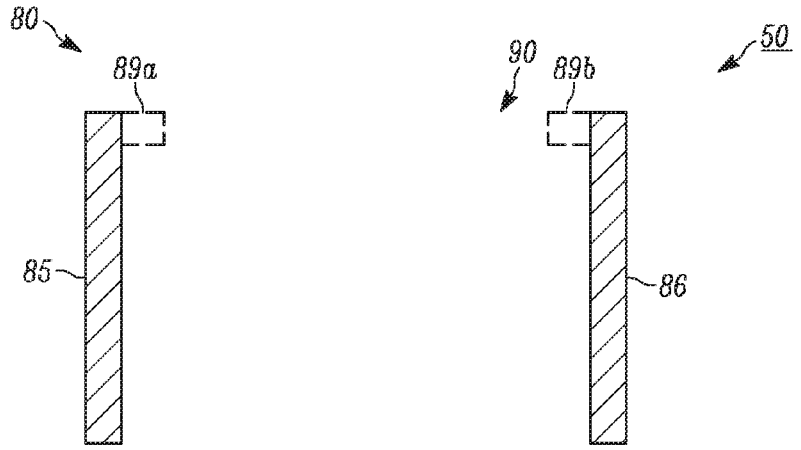
FIG. 5A is a cross-sectional view along a first main member of FIG. 5 along section lines 5A-5A.

Located substantially about the medial point along the first main member 50 and the first supplemental member 54 is a hinge pin 68 (extending across stiffening flanges 85 and 86 of the main member, see FIG. 5A) that allows for relative rotation of the first members 50, 54 during the opening and closing of the awning canopy assembly 20. In one example embodiment, the first supplemental member 54 comprises a first section 54*a* and a second section 54*b*, wherein the first section is between the hinge pin 68 and the first end 76 of the first supplemental member and the second section is between the hinge pin and the second end 78 of the first supplemental member. Near or above the hinge pin 68, a slot 80 is formed within a lateral flange 89 of the first main member 50 that is no greater than twice the width of first supplemental member 54. In one example embodiment, the width w is two inches (2"), so the slot 80 is approximately three and one-half inches (3.5"), not exceeding four (4"). The slot 80 allows for the second end 78 of the first supplemental member 54 to pass through the first main member 50 and pivot about the hinge pin 68. The slot 80 defines an opening in the lateral flange 89 as illustrated in FIGS. 5 and 5A. In one example embodiment, the slot 80 is formed between the first and second stiffening flanges 85 and 86, wherein the lateral flange 89 is removed by the formation of the slot.

Figure 5B:
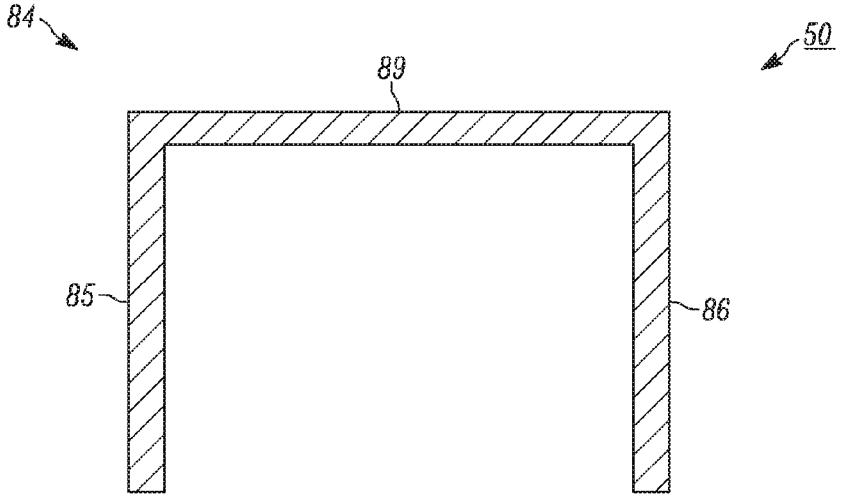
FIG. 5B is a cross-sectional view along a first main member of FIG. 5 along section lines 5B-5B.
Figure 5D:
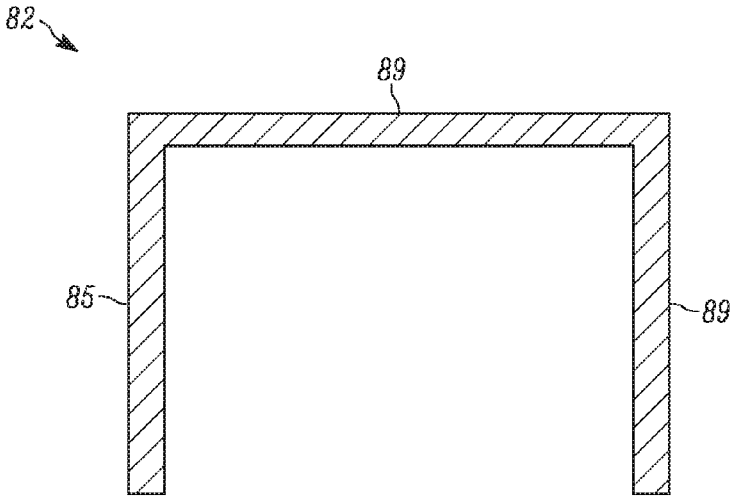
FIG. 5D is a cross-sectional view along a first main member of FIG. 5 along section lines 5D-5D.

In one example embodiment, toward the first end 72 of the first main member 50 away from the slot 80, the cross-section of the first main member comprises a first C-shaped channel 82 as illustrated in FIG. 5 and in the section view of FIG. 5D taken along section lines 5D-5D in FIG. 5. In this example embodiment, toward the second end 74 of the first main member 50 away from the slot 80, the cross-section of the first main member comprises a second C-shaped extrusion 84 as illustrated in FIG. 5 and in the section view of FIG. 5B along section lines 5B-5B in FIG. 5. In another example embodiment, the first main member 50 comprises the first C-shaped channel 82 between the first end 72 and the slot 80 and the second C-shaped channel 84 between the slot 80 and the second end 74. In the illustrated example embodiment, portions 89*a*, 89*b* (shown in dashed lines) of the lateral wall 89 are residually present in the slot 80 (see FIG. 5A). In one example embodiment, the lateral flange 89 interacts with a sidewall of the first supplemental member 54 when in the retracted position, such that a portion of the first supplemental member 54 is housed within the second C-shaped channel 84.

Figure 5C:
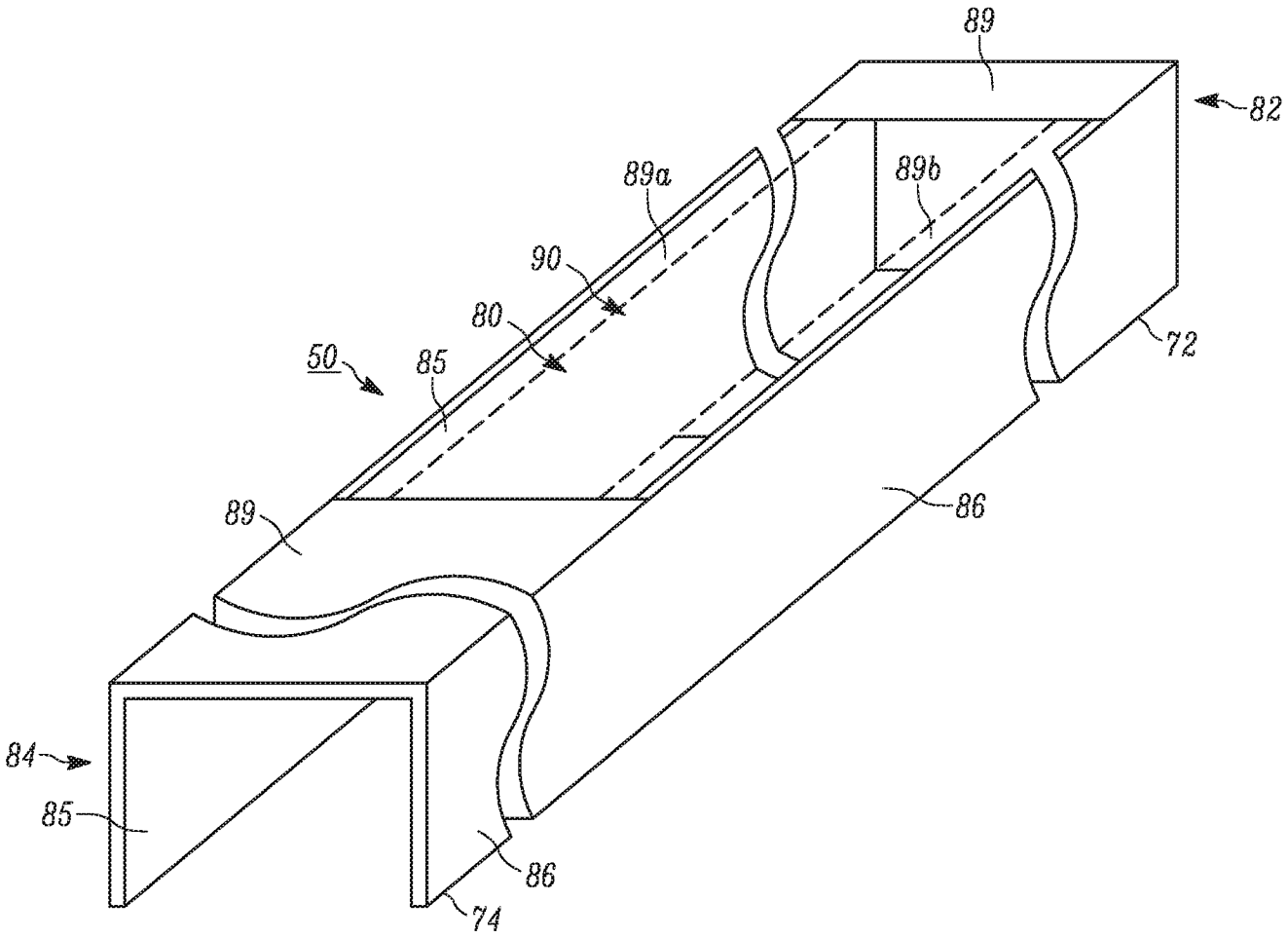
FIG. 5C is a perspective view of a first main member constructed in accordance with one example embodiment of the present disclosure.

FIG. 5C illustrates the first main member 50 and how the stiffening flanges 85 and 86 of the C-shaped channel 82 are continuously extruded into the second C-shaped channel 84, forming stiffening flanges or walls that link the first and second C-shaped channels 82, 84. Additionally, FIG. 5C illustrates how the lateral flange 89 is continuous, absent the slot 80, between the first C-shaped channel 82 and the second C-shaped channel 84, integrally connecting the stiffening flanges 85, 86 together. The first C-shaped channel 82 includes first and second stiffening flanges 85 and 86 that are spaced and supported by the lateral flange 89. The slot 80 includes a pocket 90 that nest the second end 78 of the first supplemental member 54 when the support system 36 is in the fully retracted first position, such that no portion of the second end extends beyond the stiffening flanges 85 or 86. In one example embodiment, the nesting of the second end 78 within the slot 80 is such that it forms a press-fit connection when in the fully retracted first position.

The second C-shaped channel 84 nest the first end 76 of the first supplemental member 54 when the support system 36 is in the fully retracted first position, such that no portion of the first end extends beyond the stiffening flanges 85 or 86. In one example embodiment, the nesting of the first end 76 within the second C-shaped channel 84 is such that it forms a press-fit connection when in the fully retracted first position.

The first and second supplemental members 54, 56, respectively are box-shaped channels made from metal, such as aluminum or steel. Similarly all of the pins, such as rotating pins, fixed pins, hinge pins, and sliding pins are made from metal, such as aluminum or steel and attached to the members by cotter pins or other conventional fastening means as would be appreciated by one of ordinary skill in the art. It would be appreciated by one having ordinary skill in the art that attachment means other than pins are contemplated.

Figure 4:
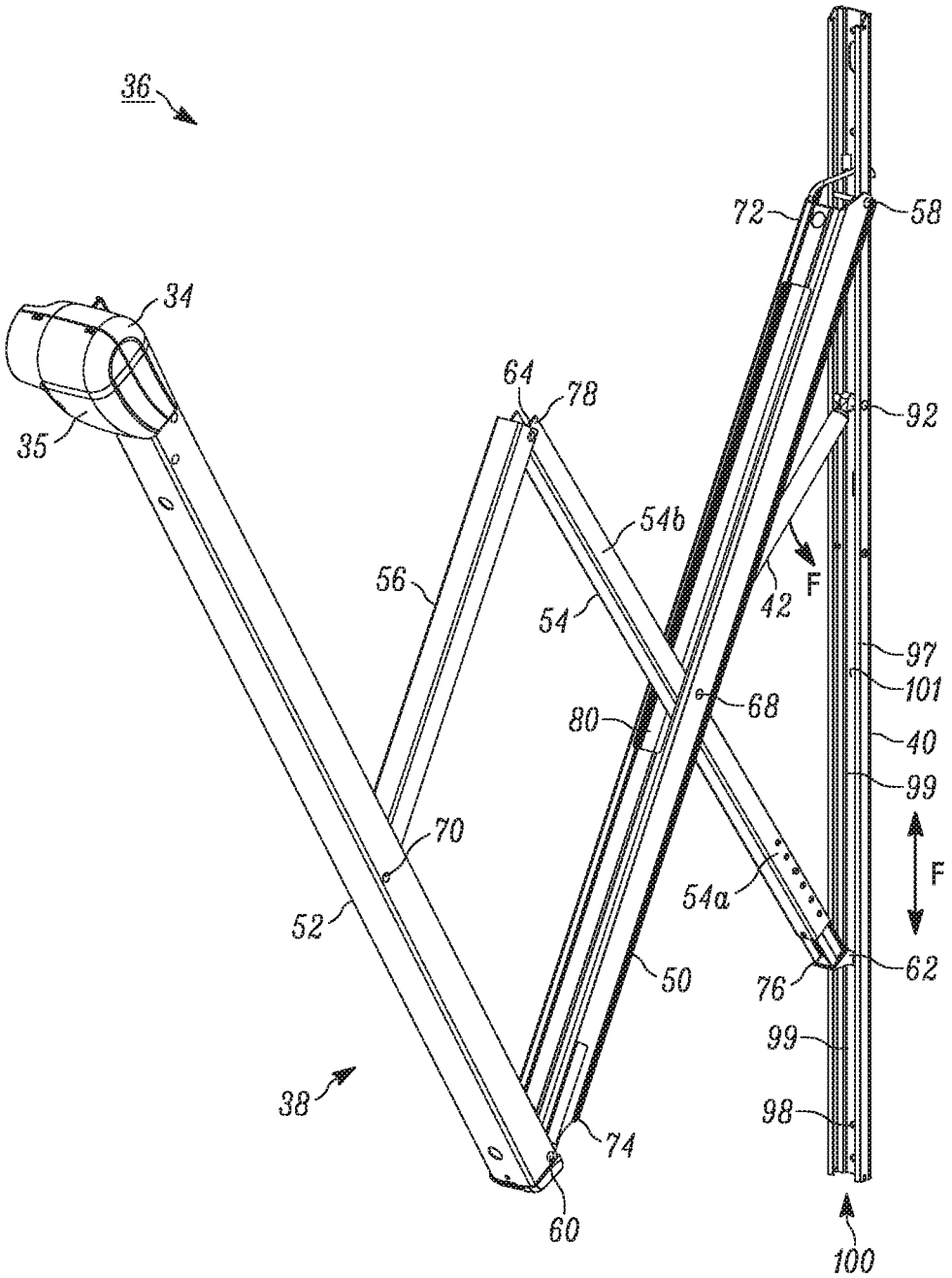
FIG. 4 is a perspective view of an awning canopy assembly support system constructed in accordance with one example embodiment of the present disclosure.
Figure 6:
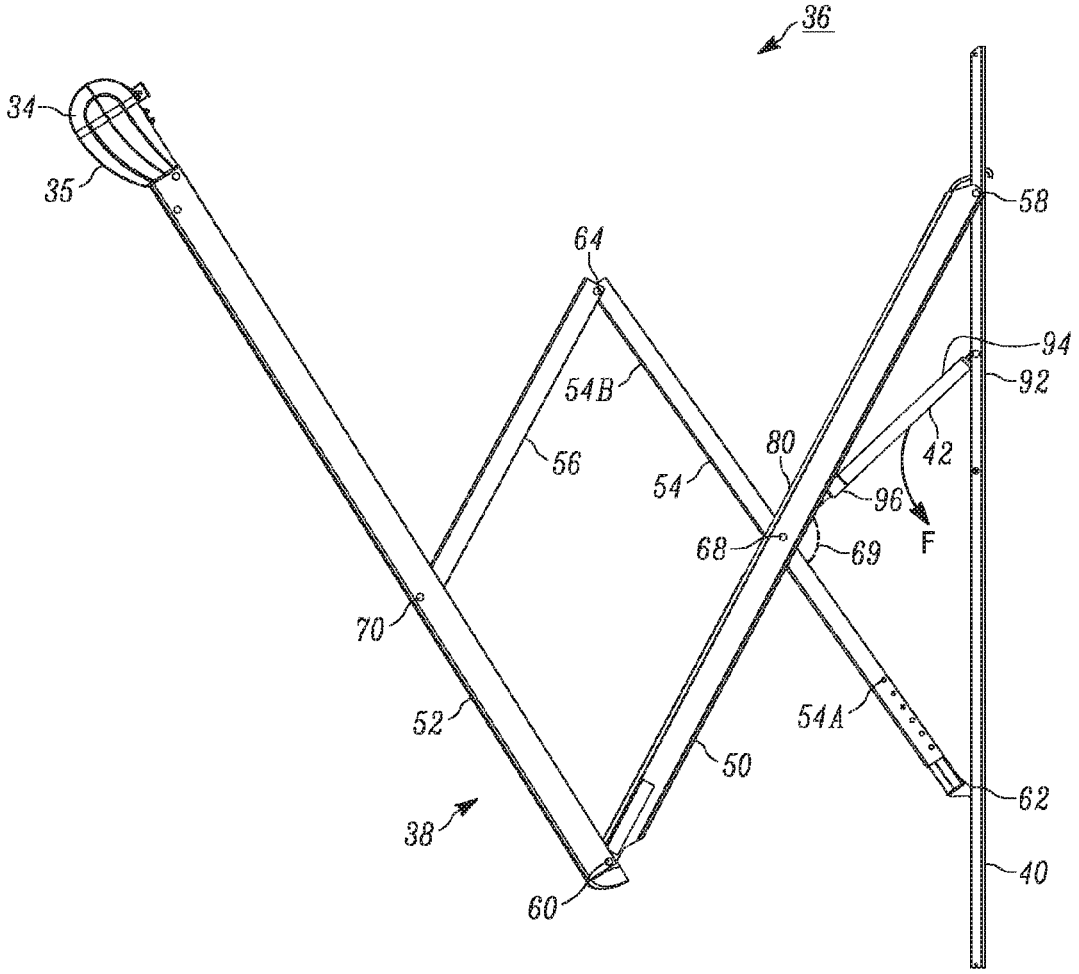
FIG. 6 is a side elevation view of FIG. 4.

Illustrated in FIGS. 4 and 6, but omitted from FIG. 5 as part of the support system 36 is gas spring 42. The gas spring 42 is rotatably connected to the vertical track 40 by a fixed pin 92 at a first end 94 of the gas spring. The vas spring 42 is also rotatably connected to the hinge pin 68 at a second end 96 of the gas spring. The gas spring 42 acts as an assist to more readily move the awning assembly 20 between the fully retracted first position (see FIG. 1) to the fully expanded second position (see FIG. 3).

When rotated to the first contracted or closed position as indicated by arrow F, the gas spring 42 resides in a first portion 101 of a pocket 98 formed by a U-shaped channel 100 in the vertical track 40. Similarly, in one example embodiment, when rotated to this first contracted or closed position as indicated by arrow F, the first end 76 of the first supplemental member 54 resides in at least partially in a different or second portion 99 of the pocket 98 formed by the channel 100 in the vertical track 40, wherein the first end 76 also at least partially resides with the second C-shaped channel 84. When the awning assembly 20 is advanced to the first closed or contracted position of FIG. 1, the second supplemental member 56 is received within a U-shaped channel 102 formed within the second main member 52 (see FIG. 5). In one example embodiment, when the awning assembly 20 is in the first closed position, the gas spring 42 is at a first angle 69 relative to the first portion 54*a* of the first supplemental member 54 in the U-shaped channel 102. The first angle is between about 180° to about 140°.

Because the gas spring 42 and first end 76 of the first supplemental member 54 are connected at the same rotational point, namely the hinge pin 68, both the gas spring and first end 76 form a compact fit within the U-shaped channel 100 and the second C-shaped channel 84, respectively, when in the first closed position. This compact fit advantageously reduces bulky awning assemblies when in the first closed position, thus reducing breakage during transport. While the first C-shaped channel 82 and second C-shaped channel 84 that form the majority of the first main member 50, provides superior strength to the support system 36 over conventional awning assemblies. In addition, such construction of the support system 36 requires fewer parts for assembly over conventional awnings. Finally, the single pieces construction of the first main member 50 provides smoother opening and closing of the awning assembly 20 over conventional awning that include two piece construction that could lead to racking and require great loads on the motor during operation.

The benefits, advantages, solutions to problems, and any element(s) that may cause any benefit, advantage, or solution to occur or become more pronounced are not to be construed as a critical, required, or essential features or elements of any or all the claims. The disclosure is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. An awning assembly comprising:

a first main member rotatably coupled to a vertical track at a first end of said first main member;

a second main member pivotally coupled to and at a second end of the first main member;

a first supplemental member rotatably and slidably connected to said vertical track at a first end of said first supplemental member;

a second supplemental member having a first end pivotally coupled to and at a second end of the first supplemental member, the second supplemental member having a second end pivotally coupled to said second main member;

a pivotal connection between said first main member and said first supplemental member;

a gas spring, wherein said gas spring includes a first end and a second end, the first end being pivotally connected to said vertical track and said second end being connected to said pivotal connection; and said first main member comprising first, second, and third cross-sections, the second cross-section defining a slot that spaces the first and third cross-sections, the slot allowing for the passage of said first supplemental member through said first main member, wherein said first cross-section differs from said second cross-section, and wherein the first cross-section and the third cross-section comprise C-shaped channels.

2. The awning assembly of claim 1 wherein said wherein said pivotal connection between said first supplemental member and said first main member comprises a hinge pin that transects sidewalls of the first supplemental member and the first main member.

3. The awning assembly of claim 1 wherein said pivotal connection comprises a hinge pin for forming a hinge pin connection between said first main member and said first supplemental member.

4. The awning assembly of claim 3 wherein said hinge pin connection occurs at the second cross-section between two stiffing flanges comprised in the slot of said first main member.

5. The awning assembly of claim 3 wherein said vertical track further comprises a U-shaped channel for nesting said gas spring and at least a portion of a first section of said first supplemental member when the assembly is in a closed position, the first section located between the hinge pin and the first end of the first supplemental member.

6. The awning assembly of claim 5 wherein responsive to the awning assembly being in a first closed position, the gas spring is at a first angle relative to the first portion of the first supplemental member while in the U-shaped channel, wherein the first angle is between about 180° to about 140°.

7. The awning assembly of claim 1 wherein said first, second, and third cross-sections share first and second stiffening flanges.

8. The awning assembly of claim 1 wherein the vertical track is coupled to a dwelling.

9. A method of constructing an awning assembly, the method comprising:

rotatably coupling a first main member to a vertical track at a first end of said first main member;

pivotally coupling a second main member to and at a second end of the first main member;

rotatably and slidably connecting a first supplemental member to said vertical track at a first end of said first supplemental member, said first supplemental member is pivotally connected to said first main member by a hinge pin;

pivotally coupling a first end of a second supplemental member to and at a second end of the first supplemental member, the second supplemental member having a second end pivotally coupled to said second main member;

forming a pivotal connection between said first main member and said first supplemental member;

connecting a first end of a gas spring to said vertical track and a second end of the gas spring to said pivotal connection; and providing said first main member with a first cross-section comprising a C-shaped channel, a second cross-section defining a slot, and a third cross-section comprising a second C-shaped channel, the slot spacing the first cross-section and third cross-section and allowing for the passage of said first supplemental member through said first main member.

10. An awning assembly comprising:

at least one support structure coupled to a canopy, the at least one support structure having:

a first main member rotatably coupled to a vertical track at a first end of said first main member, wherein the vertical track is couplable to a support surface;

a second main member pivotally coupled to a second end of the first main member at a first end of the second main member, and coupled to the canopy at a second end of the second main member;

a first supplemental member comprising a first end rotatably and slidably connected to said vertical track;

a second supplemental member having a first end pivotally coupled to a second end of the first supplemental member, the second supplemental member having a second end pivotally coupled to said second main member;

said first main member comprising a first cross-section, comprising a first C-shaped channel, and a second cross-section, defining a slot formed through a C-shaped channel and a third cross-section comprising a second C-shaped channel, the slot allowing for the passage of said first supplemental member through said first main member, wherein said first supplemental member is pivotally connected to said first main member by a hinge pin; and a gas spring, wherein said gas spring includes a first end and a second end, the first end being pivotally connected to said vertical track and said second end being connected to said hinge pin.

11. The awning assembly of claim 10 wherein said first C-shaped channel comprises first and second stiffening flanges spaced by a lateral wall.

12. The awning assembly of claim 11 wherein said second C-shaped channel comprises first and second stiffening flanges spaced by the lateral wall.

13. The awning assembly of claim 12 wherein said slot is formed in the lateral wall and the slot is defined by first and second portions of the lateral wall.

14. The awning assembly of claim 11 wherein said hinge pin connection occurs at in the second cross-section through the first and second stiffing flanges.

15. The awning assembly of claim 11 wherein said vertical track further comprises a U-shaped channel for nesting said gas spring and at least a portion of a first section of said first supplemental member when the assembly is in a closed position, the first section located between the hinge pin and the first end of the first supplemental member.

16. The awning assembly of claim 15 wherein said first, second, and third cross-sections share first and second stiffening flanges.

17. The awning assembly of claim 15 wherein responsive to the awning assembly being in a first closed position, the gas spring is at a first angle relative to the first portion of the first supplemental member while in the U-shaped channel, wherein the first angle is between about 180° to about 140°.

* * * * *